US005894113A

United States Patent [19]

Wingate

[11] Patent Number: 5,894,113

[45] Date of Patent: Apr. 13, 1999

[54] METHOD AND APPARATUS FOR PROVIDING PERSONALIZED LIGHT SOURCE AND SOUND SYSTEM

[75] Inventor: Richard Charles Wingate, Scarsdale, N.Y.

[73] Assignees: Sony Corporation, Tokyo, Japan; Sony Electronics, Inc., Park Ridge, N.J.

[21] Appl. No.: 08/928,772

[22] Filed: Sep. 12, 1997

[51] Int. Cl.[6] ..... H04R 25/00

[52] U.S. Cl. ..... 181/141; 181/129; 362/105

[58] Field of Search ..... 181/129, 130, 181/141; 381/370–384; 362/105, 106

[56] References Cited

U.S. PATENT DOCUMENTS 4,969,069 11/1990 Eichost ..... 362/105
5,353,205 10/1994 Hudak ..... 362/105

*Primary Examiner*—Khanh Dang
*Attorney, Agent, or Firm*—Ronald P. Kananen; Rader, Fishman & Grauer

[57] ABSTRACT

A method and apparatus of providing a personalized light source in conjunction with a sound system includes mounting a personalized light source on a support for supporting at least one speaker next to a wearer's ear. The personalized light source includes an effective light source mounted at the distal end a semi-flexible stem. The stem allows the effective light source to be aimed as desired by the wearer and may be extended from or retracted into the support.

17 Claims, 4 Drawing Sheets

METHOD AND APPARATUS FOR PROVIDING PERSONALIZED LIGHT SOURCE AND SOUND SYSTEM

FIELD OF THE INVENTION

The present invention relates to the fields of personal stereo equipment and personal lighting. Particularly, the present invention relates to a method and apparatus for providing a personalized light source in combination with a personalized sound system.

BACKGROUND OF THE INVENTION

The many personalized devices that have been invented in modern society provide an amazing amount of freedom and convenience to users. For example, cellular telephones allow users to make and receive calls from almost any location. Laptop computers allow users to write, work, play games, etc. while traveling or while away from the home or the office.

Additionally, a battery-powered personal stereo with headphones allows a user to take his or her favorite compact discs or audio tapes virtually anywhere. In combination with the headphones, the user can use a personal stereo to listen to music, a recorded book or any other audio program without disturbing other people who may be nearby. In addition to recorded programming, a personal stereo with headphones may include or consist of a radio frequency tuner and be used to receive and listen to radio broadcasts.

With these many portable, battery-powered, personal devices, users have a vastly increased freedom to make optimal use of their time and to do those activities they would like to do at any time and place they choose.

As mentioned, one of the great advantages of personal stereos with headphones is that an audio program can be heard without disturbing other people who may be in the immediate vicinity. This is a particularly useful advantage in that many people find it pleasant to listen to music, for example, while performing other activities such as writing, reading, traveling or exercising. As these activities may frequently be performed with others nearby, it is advantageous that audio programming can be individually selected and heard only by the wearer of the headphones. Thus, the user's desire to hear the audio programming can be satisfied without requiring those nearby to listen as well.

However, other people may be disturbed not only by hearing an unwanted audio program, but also by an ambient light level which is greater than desired. For example, while sleeping most people prefer a low light level and a low noise level. For example, someone desiring to read and listen to music in the same vicinity as someone who is trying to sleep may disturb the sleeper. The sleeper may have the desired noise level if the reader listens to the music through headphones, but the sleeper may be disturbed by the light the reader requires to see the reading material being studied.

Accordingly, there is a need in the art for a method and apparatus to enable a user to simultaneously listen to an audio program and have a sufficient light level for an activity such as reading without disturbing a companion who may desire both a low noise and low light level.

In another example, it may be noted that exercise is extremely popular in modern society and extremely beneficial to individual health and fitness. Aerobic forms of exercise such as jogging, biking, and walking are particularly popular and beneficial.

As noted, many individuals enjoy listening to music or other audio programming while exercising. This is made possible by battery-powered personal stereos which provide the desired music or other audio programming wherever the runner, biker or walker may go.

Unfortunately, due to heavily loaded schedules or to avoid the heat of the day, many people choose or are required to take their exercise early in the morning or late in the evening when the ambient outdoor light level is low. Under such circumstances, the use of a personal stereo can increase the danger the exerciser is subject to. For example, the personal stereo may prevent the exerciser from hearing the approach of a vehicle and taking appropriate precautions.

Accordingly, there is a further need in the art for a method and apparatus that increase the safety of those who choose to listen to a personal stereo while exercising in low ambient light levels.

SUMMARY OF THE INVENTION

Accordingly, it is an object of the present invention to meet the above-described need. More particularly, it is an object of the present invention to provide a method and apparatus for providing a personal light source in conjunction with a personal sound system.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve the stated and other objects of the present invention, as embodied and described below, the invention may comprise an apparatus providing a personalized light and sound system in combination, having: at least one speaker; a support for supporting the speaker and for mounting the speaker next to the ear of a user; and a personalized light source attached to the support.

The personalized light source may include a light bulb at a distal end of a stem which extends from the support. The light bulb may be backed by a reflector for directing light from the light bulb.

Alternatively, the personalized light source may include a fiber optical cable. A first end of the optical cable would extend from the support and act as an effective light source. A second end of the optical cable would be disposed adjacent to a light source for collecting light from the light source.

The support may be a band connecting two speakers. Alternatively, the support may be shaped to hang from a user's ear. The support may also incorporate a tuner and an antenna.

A stem may be mounted on the support with the personalized light source mounted on the stem. The stem is preferably semi-flexible to allow the light to be aimed by the wearer as needed. This stem may be made so that it can be extended from or retracted into the support.

The present invention also encompasses a method for providing personalized light and audio programming by mounting an effective light source on a pair of headphones.

The present invention also encompasses a method for providing personalized light and audio programming in combination, by: providing at least one speaker; supporting the at least one speaker with a support, the support allowing the at least one speaker to be mounted next to the ear of a user; and attaching a personalized light source to the support.

The step of attaching a personalized light source may be accomplished by providing a light bulb at a distal end of a stem, the stem extending from the support. The method may also include backing the light bulb with a reflector for directing light from the light bulb.

Alternatively, the step of attaching a personalized light source may be accomplished by attaching a fiber optical cable to the support, with a first end of the optical cable extending from the support and a second end of the optical cable being disposed adjacent a light source for collecting and transmitting light from the light source to the first end of the optical cable which then becomes an effective light source.

The step of supporting may be accomplished by connecting two speakers with a band. Alternatively, the step of supporting may include shaping the support to hang from a user's ear.

The present method may also include the step of supporting a tuner and an antenna with the support.

The present method may also including mounting a semi-flexible stem on the support. In which case, the step of attaching a personalized light source may be accomplished by mounting the personalized light source on the stem. The stem may be constructed so as to be able to extend from or retract into the support.

The present invention also encompasses a method of increasing the safety of people exercising to music in low ambient light levels comprising alerting other people to the presence of an exerciser by mounting an outwardly directed personalized light source on a pair of headphones worn by the exerciser.

BRIEF DESCRIPTION OF THE DRAWINGS

The accompanying drawings illustrate the present invention and are a part of the specification. Together with the following description, the drawings demonstrate and explain the principles of the present invention.

In the drawings.

DETAILED DESCRIPTION OF THE PREFERRED EMBODIMENT

Using the Figures, a detailed description of several embodiments of the present invention will now be described.

Figure 1:
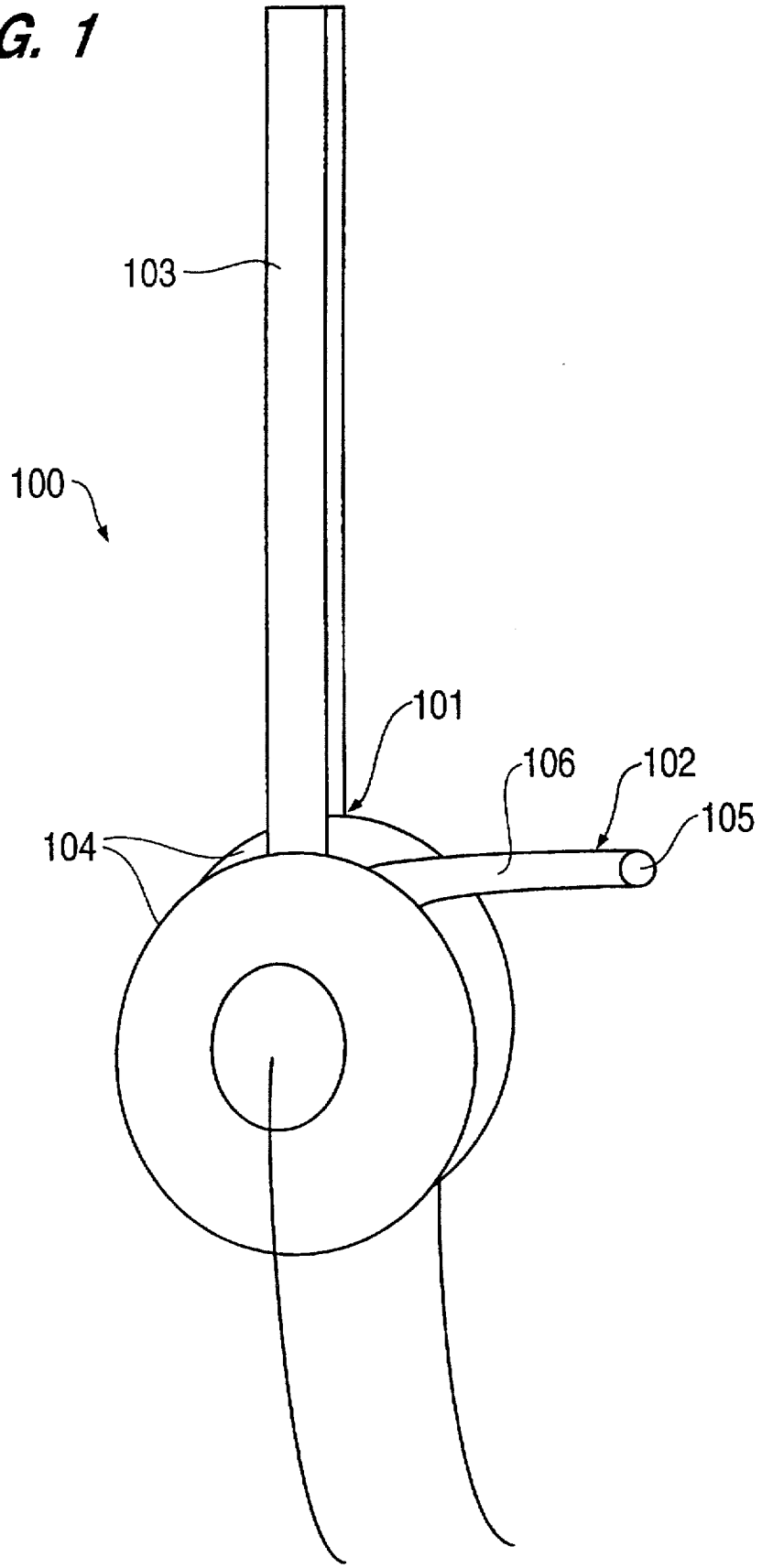
FIG. 1 illustrates an embodiment of the present invention.

As shown in FIG. 1, the present invention may be embodied in a unit 100 which combines headphones 101 with a personalized light 102. The headphones 101 may be conventional headphones having a band 103, usually of metal or plastic, which is worn over the top of the user's head. At each end of the band 103 is a small speaker housing 104 which is held against the ear of a wearer by the band 103. Each speaker housing 104 contains a speaker and may be provided with padding for making the headphones 101 more comfortable.

The personalized light 102 is supported by the headphones 101 so that light emitted from the personalized light 102 is projected in front of the wearer of the headphones 101. In this way, light from the personalized light 102 can be used for illuminating, for example, reading material.

The stem 106 of the personalized light 102 is preferably semi-flexible such that it can be reshaped at will by the user and will retain that shape until again reshaped by the user. Many means of constructing such a stem will be well-known to those in the art, all of which are considered equivalent for purposes of the present invention. In this way, the stem 106 can be shaped to a position and orientation so that the light emitted from the personalized light 102 is properly directed as desired by the user. The distal end of the stem 106 is an effective light source 105.

The effective light source 105 may be, for example, a light bulb or a light bulb backed by a parabolic reflector for directing the light emitted by the bulb outward. Alternatively, the effective light source 105 may be the end of a fiber optic cable which is disposed in the stem 106. With the fiber optic cable, a light bulb or other light source may be located elsewhere on the unit 100 or even on a personal stereo system (not shown) to which the unit 101 is connected. If the light bulb is located remote from the effective light source 105, the fiber optic cable in stem 106 can deliver the light to the effective light source 105 for use. In addition, any structural arrangement in which the effective light source 105 can be made to emit light is considered equivalent and within the scope of the invention.

Power for the personalized light source 102 may be provided from the personal stereo system or other electronic device to which the headphones 101 are connected. Alternatively, a separate battery or power source may be provided on the unit 100 for the personalized light source 102.

Figure 2:
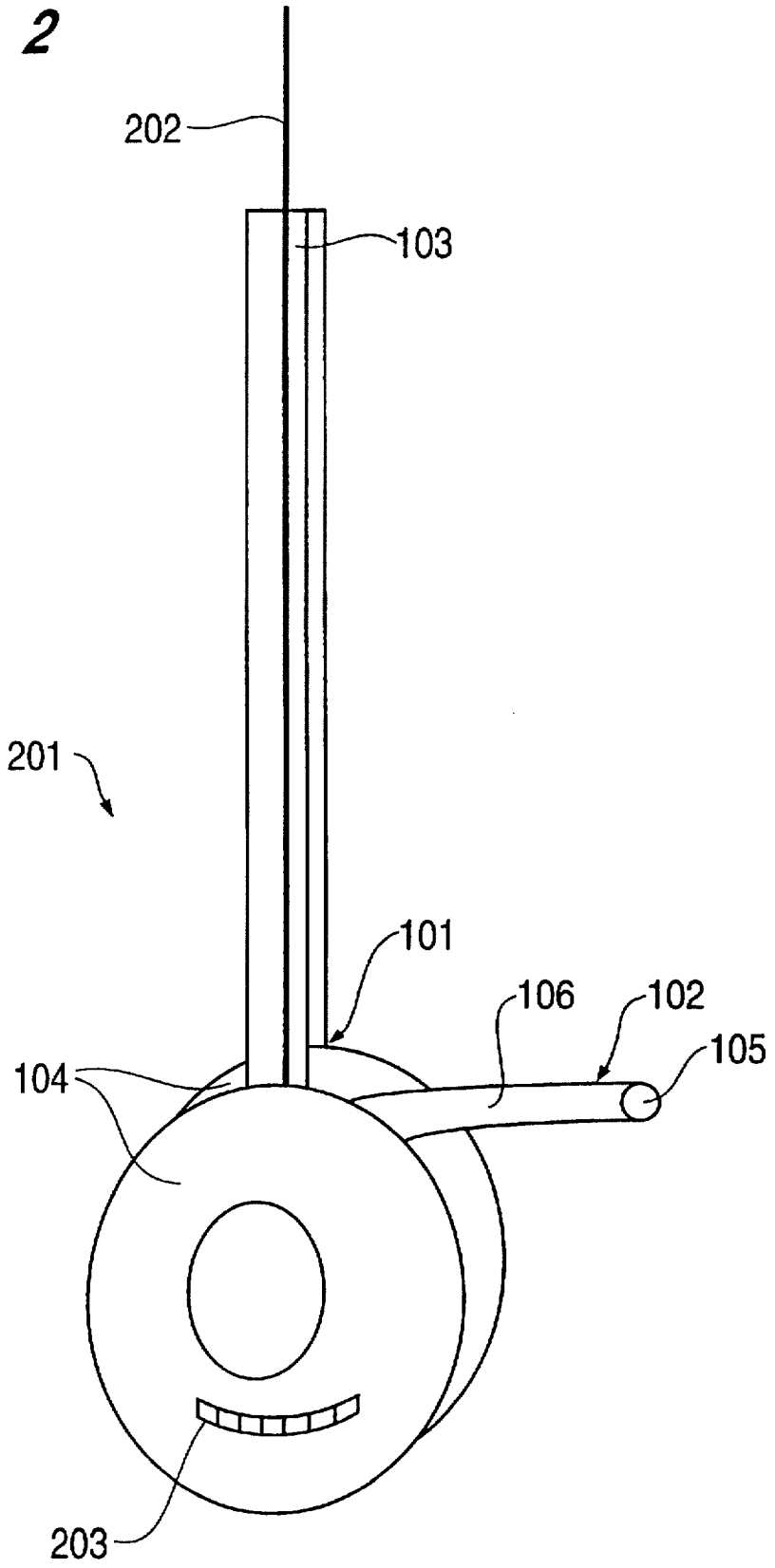
FIG. 2 illustrates a second embodiment of the present invention.

FIG. 2 illustrates an alternative embodiment in which an audio system, for example, a radio frequency tuner 203 is incorporated into the unit 201. The tuner 203 may be disposed, as in the illustrated example, within a speaker housing unit 104. An antenna 202 is also provided for aiding the reception of radio broadcasts by the tuner 203. In this embodiment, a power source will be required on the unit 201 for powering the personalized light source 102, the headphones 101 and the tuner 203.

Figure 3:
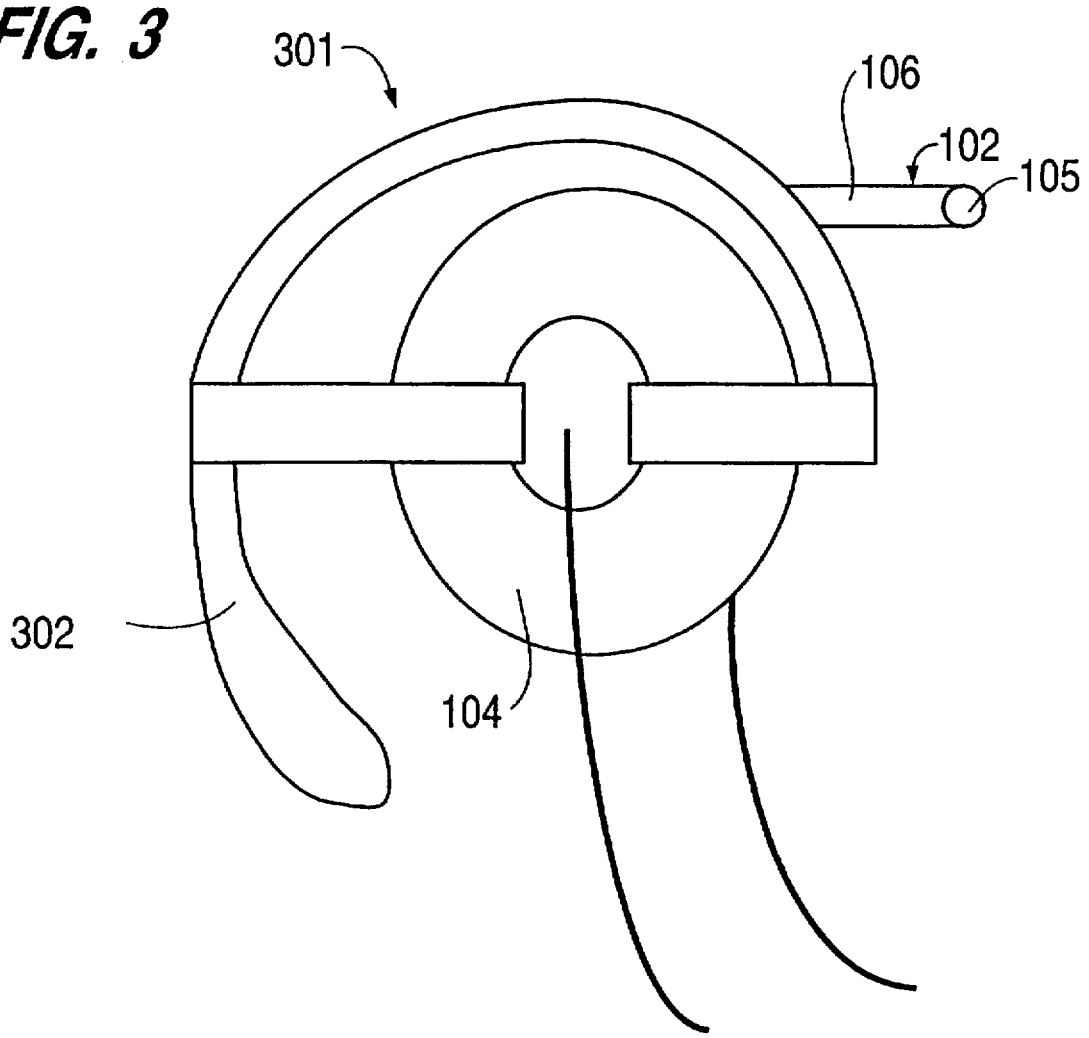
FIG. 3 illustrates a third embodiment of the present invention.

Another alternative embodiment is shown in FIG. 3. In FIG. 3, the speaker housings 104 of the unit 301 are not connected by a band. Rather, each of the two housings 104 is provided with an earpiece 302. The earpiece 302 rests on the user's ear and holds the speaker housing 104 in close proximity to the user's auditory canal. In this embodiment, the personalized light 102 is mounted on and supported by the earpiece 302.

Figure 4:
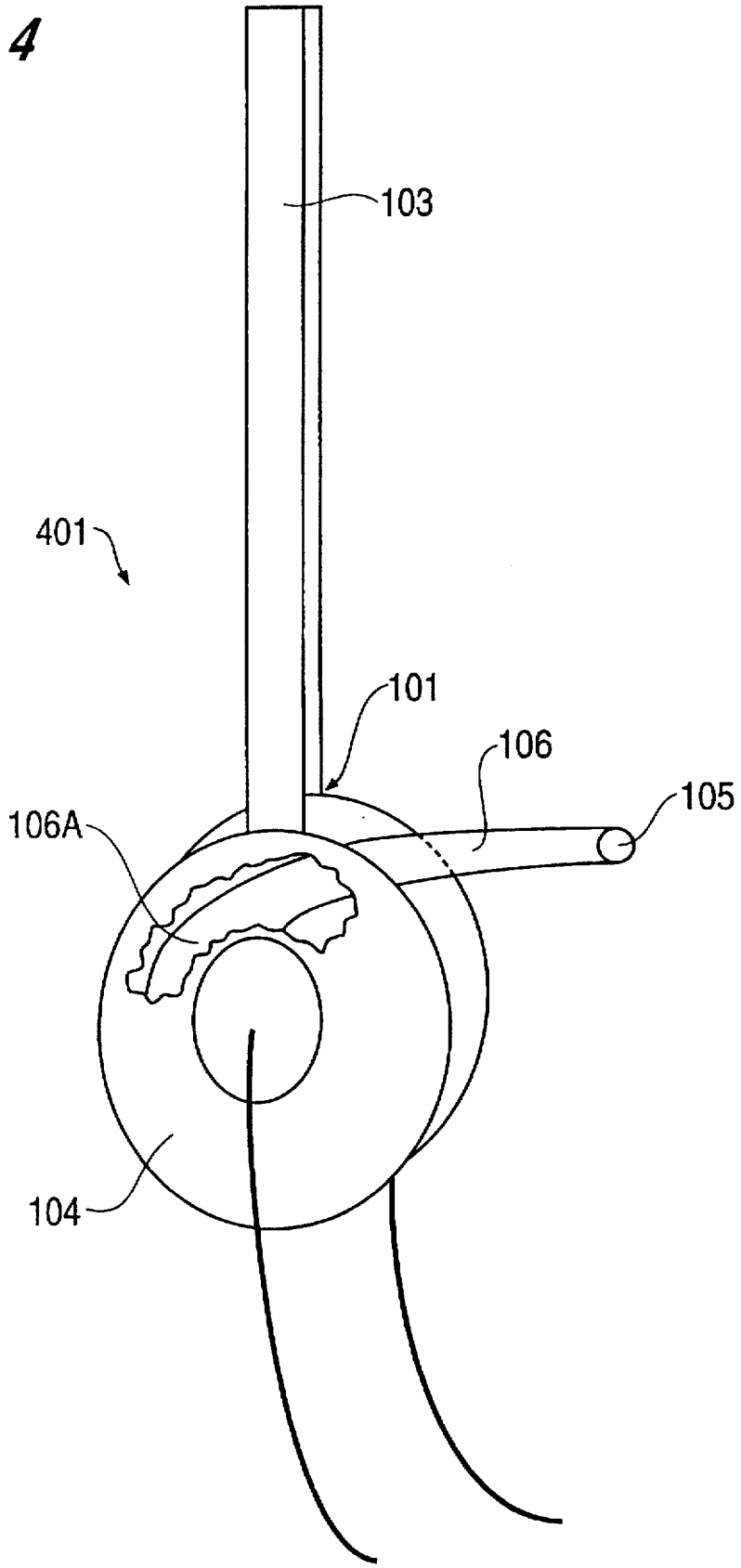
FIG. 4 illustrates a partial cutaway of a fourth embodiment of the present invention.

Finally, as shown in FIG. 4, in the present invention, the stem 106 may include a stem extension 106A which is coiled within, for example, the speaker housing 104. In this manner, the stem 106 and stem extension 106A may be pulled out of the housing 104 and extended or pushed into the housing and shortened as needed by the user. If the personalized light source is not being used at all. The stem 106 may be entirely retracted into the speaker housing 104.

It should be noted that in any of the embodiments of the present invention, a personalized light source 102 maybe provided on either or both speaker housings 104.

As described above, the various embodiments of the present invention allow the user to listen to an audio programming and have sufficient light to perform other activities such as reading.

Additionally, the various embodiments of the present invention can be used to increase the safety of joggers, walker, bikers and other exercisers who are outside exercising during periods of low ambient light, such as dusk and dawn and wish to listen to an audio program with headphones. With the present invention, the personalized light 102 can be directed in front of or behind the wearer to alert vehicles and other pedestrians to the presence of the wearer, thereby increasing the wearer's safety.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. An apparatus providing a personalized light and sound system in combination, comprising:

at least one speaker;

a support for supporting said at least one speaker and for mounting said at least one speaker next to the ear of a user;

a personalized light source attached to said support; and a radio frequency tuner and an antenna supported by said support.

2. An apparatus providing a personalized light and sound system in combination, comprising:

at least one speaker;

a support for supporting said at least one speaker and for mounting said at least one speaker next to the ear of a user; and a personalized light source attached to said support;

wherein said personalized light source includes a light bulb at a distal end of a stem, said stem extending from said support.

3. An apparatus as claimed in claim 2, wherein said light bulb is backed by a reflector for directing light from said light bulb.

4. An apparatus providing a personalized light and sound system in combination, comprising:

at least one speaker;

a support for supporting said at least one speaker and for mounting said at least one speaker next to the ear of a user; and a personalized light source attached to said support;

wherein said personalized light source comprises a fiber optical cable, with a first end of said optical cable extending from said support as an effective light source and a second end of said optical cable being disposed adjacent a light source for collecting and transmitting light from said light source to said first end.

5. An apparatus as claimed in claim 2, wherein said support comprises a band connecting two speakers.

6. An apparatus providing a personalized light and sound system in combination, comprising:

at least one speaker;

a support shaped to hang from a user's ear while supporting said at least one speaker against the ear of a user; and a personalized light source attached to said support.

7. An apparatus providing a personalized light and sound system in combination, comprising:

at least one speaker;

a support for supporting said at least one speaker and for mounting said at least one speaker next to the ear of a user;

a personalized light source attached to said support; and a stem mounted on said support, wherein:

said personalized light source is mounted on said stem; and said stem is semi-flexible.

8. An apparatus as claimed in claim 7, wherein said stem can be extended from or retracted into said support.

9. A method for providing personalized light and audio programming in combination, comprising:

providing at least one speaker;

supporting said at least one speaker with a support, said support allowing said at least one speaker to be mounted next to the ear of a user;

attaching a personalized light source to said support; and, supporting a radio-frequency tuner and an antenna with said support.

10. A method for providing personalized light and audio programming in combination, comprising:

providing at least one speaker;

supporting said at least one speaker with a support, said support allowing said at least one speaker to be mounted next to the ear of a user; and attaching a personalized light source to said support;

wherein said attaching a personalized light source includes providing a light bulb at a distal end of a stem, said stem extending from said support.

11. A method as claimed in claim 10, further comprising backing said light bulb with a reflector for directing light from said light bulb.

12. A method for providing personalized light and audio programming in combination, comprising:

providing at least one speaker;

supporting said at least one speaker with a support, said support allowing said at least one speaker to be mounted next to the ear of a user; and attaching a personalized light source to said support;

wherein said attaching a personalized light source comprises attaching a fiber optical cable to said support, with a first end of said optical cable extending from said support and a second end of said optical cable being disposed adjacent a light source for collecting and transmitting light from said light source to said first end.

13. A method as claimed in claim 10, wherein said supporting comprises connecting two speakers with a band.

14. A method for providing personalized light and audio programming in combination, comprising:

providing at least one speaker;

supporting said at least one speaker with a support which hangs from a user's ear to mount said at least one speaker against the ear of a user; and attaching a personalized light source to said support.

15. A method for providing personalized light and audio programming in combination, comprising:

providing at least one speaker;

supporting said at least one speaker with a support, said support allowing said at least one speaker to be mounted next to the ear of a user;

attaching a personalized light source to said support; and mounting a semi-flexible stem on said support, wherein said attaching a personalized light source comprises mounting said personalized light source on said stem.

16. A method as claimed in claim 15, wherein said stem can be extended from or retracted into said support.

17. A method of increasing the safety of people exercising to music in low ambient light levels comprising alerting other people to the presence of an exerciser by mounting an outwardly directed personalized light source on a pair of headphones worn by said exerciser.

* * * * *